United States Patent [19]

Madgavkar

[11] Patent Number: 4,605,489

[45] Date of Patent: Aug. 12, 1986

[54] UPGRADING SHALE OIL BY A COMBINATION PROCESS

[75] Inventor: Ajay Madgavkar, Katy, Tex.

[73] Assignee: Occidental Oil Shale, Inc., Grand Junction, Colo.

[21] Appl. No.: 749,219

[22] Filed: Jun. 27, 1985

[51] Int. Cl.[4] ..... C10G 21/16

[52] U.S. Cl. ..... 208/87; 208/50; 208/97; 208/110; 208/133; 208/251 R; 208/254 R; 208/254 H; 208/282

[58] Field of Search ..... 208/254 R, 254 H, 87, 208/97, 265, 269, 282, 270, 133, 95, 50, 100, 251 R

[56] References Cited

U.S. PATENT DOCUMENTS

| | | | |
|---|---|---|---|
| 2,309,324 | 1/1943 | McAllister et al. | 208/282 |
| 2,847,362 | 8/1958 | Kemp | 208/87 |
| 3,013,962 | 12/1961 | Kimberlin, Jr. et al. | 208/254 R |
| 4,159,940 | 7/1979 | Smith | 208/254 H |
| 4,209,385 | 6/1980 | Stover | 208/254 R |
| 4,271,009 | 6/1981 | Stover et al. | 208/282 |
| 4,272,361 | 6/1981 | Compton | 208/254 R |
| 4,287,051 | 9/1981 | Curtin | 208/254 H |
| 4,426,280 | 1/1984 | Chen et al. | 208/270 |

*Primary Examiner*—Andrew H. Metz
*Assistant Examiner*—Anthony McFarlane
*Attorney, Agent, or Firm*—Christie, Parker & Hale

[57] ABSTRACT

A method for reducing the nitrogen content of shale oil is disclosed. The method comprises selectively extracting nitrogen-containing compounds to form a nitrogen-lean raffinate and a nitrogen-rich extract. The nitrogen-lean raffinate is distilled to form a distillate having a further reduced nitrogen content and a bottoms having a further increased nitrogen content. The bottoms is hydrotreated to remove nitrogen-containing compounds. Extracted shale oil compounds may be combined with the bottoms prior to the hydrotreatment or may be used to generate hydrogen gas for the hydrotreatment. Arsenic-containing compounds are removed from the distillate by extraction.

49 Claims, 1 Drawing Figure

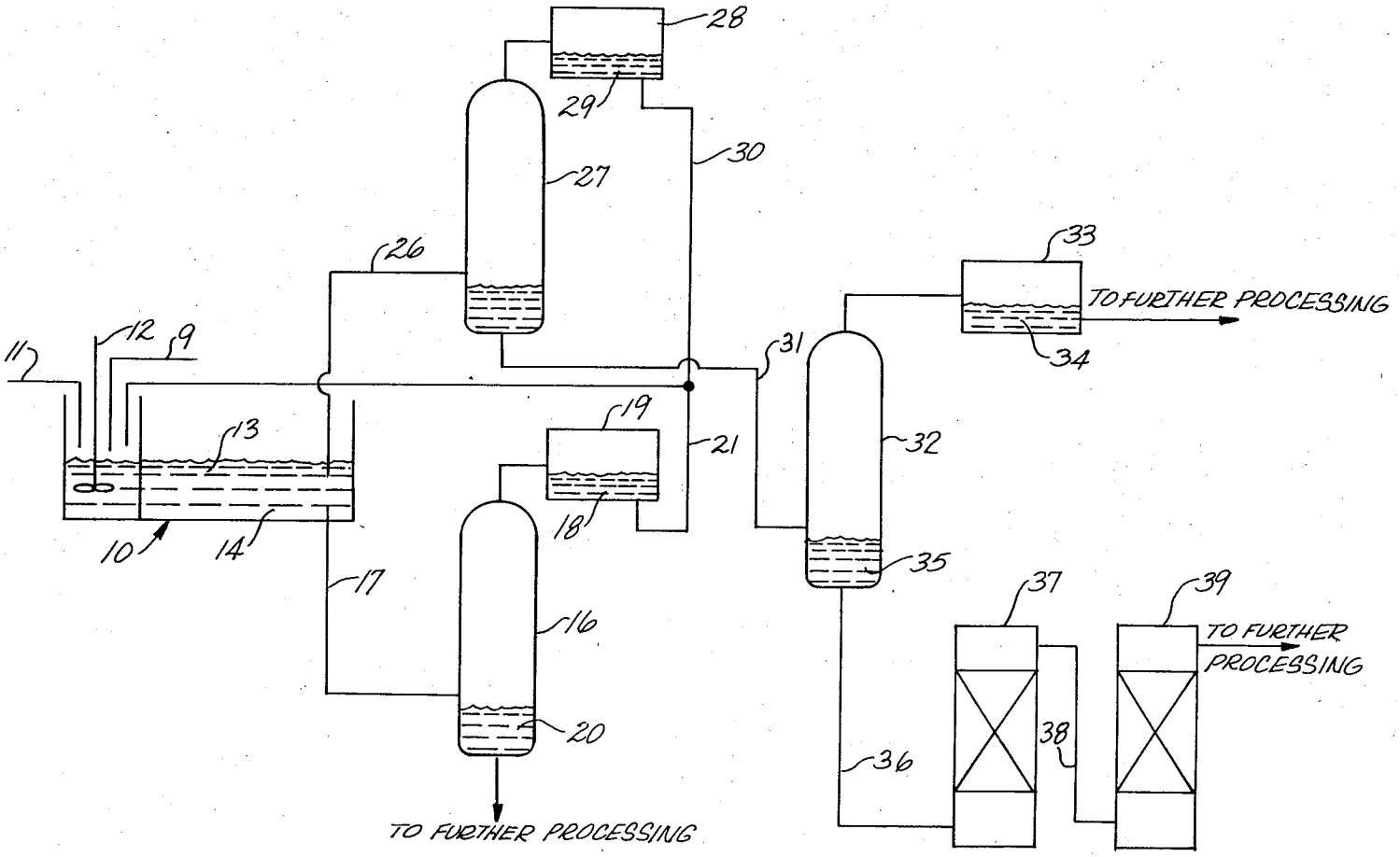
TO FURTHER PROCESSING
TO FURTHER PROCESSING
TO FURTHER PROCESSING
9
10
11
12
13
14
16
17
18
19
20
21
26
27
28
29
30
31
32
33
34
35
36
37
38
39

UPGRADING SHALE OIL BY A COMBINATION PROCESS

FIELD OF THE INVENTION

The process herein relates to upgrading shale oil by first contacting the shale oil with a nitrogen extracting agent and then distilling the shale oil to produce a distillate having a further reduced nitrogen content and a bottoms having an increased nitrogen content which is then mildly hydrotreated.

BACKGROUND OF THE INVENTION

The term "oil shale as used in the industry refers to a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil".

In a preferred practice of the method described herein, the method is utilized for refining shale oil produced from in situ retorting of oil shale. An in situ shale retort can be formed by many methods, such as the methods disclosed in U.S. Pat. Nos. 3,661,423; 4,043,595; 4,043,596; 4,043,597; and 4,043,598, all of which are incorporated herein by this reference.

The process can also be practiced on shale oil produced by other methods of retorting. Many of these methods for shale oil production are described in *Synthetic Fuels Data Handbook*, compiled by Dr. Thomas A. Henrickson, and published by Cameron Engineers, Inc., Denver, Colo. For example, other processes for retorting oil shale include those known as the TOSCO, Paraho Direct, Paraho Indirect, N-T-U, and Bureau of Mines, Rock Springs, processes.

Kerogen is considered to have been formed by the deposition of plant and animal remains in marine and nonmarine environments. Its formation is unique in nature. Alteration of this deposited material during subsequent geological periods produced a wide variety of organic materials. Source material and conditions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures of asphalts and bitumens.

Shale oils are generally high molecular weight, viscous organic liquids, of predominantly hydrocarbonaceous oxygen, nitrogen and sulfur-containing organic compounds produced from oil shale. The shale oils are of varying linear, branched cyclic, aromatic hydrocarbon and substituted hydrocarbon content with high pour points, moderate sulfur content, large amounts of metallic impurities, especially arsenic, and relatively high nitrogen content.

The shale oil produced from an oil shale formation can vary between strata within the oil shale formation. The nitrogen content of shale oil can also vary dependent upon the geographical location of the oil shale deposit from which the shale oil is produced. Such a variance in nitrogen content in different geographical locations can be atttibuted to differences in the environment during the time of the deposition of the organisms which, upon lithification, become oil shale. Such a variance can also be attributed to the different types of organisms in the separate geographical locations which were deposited to form the organic substance in the oil shale and any organisms within the formed deposit layer which acted upon such deposited material to provide the kerogen within the oil shale formation. Furthermore, the nitrogen content of shale oil may vary according to the process and operating variables used to produce it.

The nitrogen content in shale oil is attributable to basic nitrogen-containing compounds and non-basic nitrogen-containing compounds. The relative percentages of the basic and non-basic nitrogen compounds comprising the total nitrogen content of a shale oil varies depending upon the particular shale oil but typically are in the ranges of 60% to 70% basic nitrogen-containing compounds and 30% to 40% non-basic nitrogen-containing compounds.

The nitrogen content of shale oil is generally up to about two percent by weight. For example, the average nitrogen content of shale oil recovered by in situ retorting of oil shale from the Piceance Creek Basin of Western Colorado is on the order of about 1.4% by weight. This is very high when compared with the nitrogen content of crude petroleum which is typically no more than about 0.3% by weight.

The presence of nitrogen in shale oil presents many problems in that the nitrogen can interfere with refining and the transportation and use of shale oil. Deleterious effects brought about by the presence of nitrogen in shale oil are decreased catalyst life in hydrogenation, reforming, hydrocracking and catalytic cracking reactions, decreased chemical stability of products, and decreased color stability of products.

Another problem with the presence of nitrogen in shale oil is that it is undesirable to transport nitrogen-containing shale oil through pipelines which are also used for transporting petroleum products because of possible contamination of such products with residual nitrogen-containing shale oil in the pipeline. Generally such petroleum products contain a very low nitrogen content. The relatively high nitrogen content in the shale oil can pollute the pipelines making them undesirable and uneconomical for transporting such low nitrogen-containing petroleum products. In addition, a high nitrogen content in shale oil can cause clogging of pipelines due to self-polymerization brought about by the reactivity of the nitrogen-containing compounds. Due to the basicity of the nitrogen-containing compounds in shale oil, some corrosion can occur, thus damaging a pipeline used to transport shale oil.

Product stability is a problem that is common to many products derived from shale oil with the major exception of the asphalt cut and those products that have undergone extensive hydrotreating. Such instability, including photosensitivity, is believed to result primarily from the presence of nitrogen-containing compounds.

It is, therefore, desirable to reduce the nitrogen content of shale oil to increase the utility, transportability, and stability of the shale oil and the products derived from such shale oil.

Conventionally, nitrogen removal in shale oil has been achieved by hydrogenation processes, extraction processes or a combination of both processes.

In extraction processes, the shale oil is contacted with an extraction agent, usually an immiscible solvent capable of selectively extracting nitrogen-containing compounds. As illustrative, U.S. Pat. No. 4,272,361 to Compton discloses a method for reducing the nitrogen content of shale oil by contact with an aqueous solution comprising an active solvent for nitrogen-containing compounds and sufficient water to provide phase separation. The active solvent is selected from the group consisting of organic acids and substituted organic acids.

Extraction processes are useful in extracting a portion of the nitrogen-containing compounds from shale oil. However, the selectivity of these processes is insufficient to reduce the nitrogen content to a level wherein the shale oil can undergo further refinement, such as catalytic cracking, without extracting a significantly large portion of the non-nitrogen-containing compounds. This leads to a low oil recovery.

In hydrogenation processes, also referred to as hydrotreating, the shale oil is heated in the presence of hydrogen gas under extreme pressure. This results in a very large consumption of hydrogen gas. For example, reduction of the nitrogen content of shale oil to about 500 ppm may require a partial hydrogen pressure of about 2,000 psi or more at a temperature of from about 760° F. to 790° F. and from about 0.5 to about 1.0 liquid hourly space velocity (LHSV). Hydrogen consumption of about 2,500 standard cubic feet per barrel results.

Combination processes inclucing extracting extraction and hydrotreating have also been disclosed. The object of these processes is to provide a method for reducing the hydrogen consumption that results from upgrading high nitrogen oil feed stocks.

For example, in U.S. Pat. No. 4,159,940 to Smith, there is disclosed a process wherein a high nitrogen syncrude feed is contacted with at least one acid selected from the group consisting of sulfuric, phosphoric and hydrochloric acids to produce a first phase low in nitrogen and a second phase high in nitrogen. The second phase then undergoes severe hydrotreating and the first phase undergoes mild hydrotreating.

U.S. Pat. No. 4,261,813 also to Smith improves the above process by removing the acid solvent from the high nitrogen phase to produce a high-nitrogen extract oil which is passed to a hydrogen-producing plant to supply hydrogen for hydrotreating. The low nitrogen first phase is hydrotreated at mild conditions.

U.S. Pat. No. 4,287,051 to Curtin discloses a process wherein a high nitrogen feed oil is separated into a first portion and a remaining highly viscous portion. Nitrogen compounds are extracted from the first portion with an acid solvent to produce a low nitrogen raffinate and a high nitrogen extract. The acid solvent is then recovered from the extract to produce a high-nitrogen extract oil. The highly viscous portion and the high-nitrogen extract oil are partially oxidized to produce hydrogen which is used to mildly hydrotreat the low nitrogen raffinate.

These combination processes demonstrate an attempt to reduce the hydrogen consumption of hydrotreating shale oil by incorporating a liquid extraction step. However, to maximize oil recovery, both the low nitrogen phase and the high nitrogen phase resulting from the extraction must be hydrotreated. This results in separate hydrotreating which is expensive. The alternative is to not hydrotreat the second high nitrogen phase. However, this reduces oil recovery.

SUMMARY OF THE INVENTION

There is provided a process for reducing the nitrogen content of shale oil. The process comprising first contacting a shale oil feed with an extraction agent capable of selectively extracting nitrogen-containing compounds from shale oil, preferably an aqueous solution containing an organic acid solvent, to form a nitrogen-lean raffinate and a nitrogen-rich extract. The raffinate is then separated from the extract.

The nitrogen-rich extract is treated to recover the extraction agent. When an organic acid solvent is used as the extraction agent, the nitrogen-rich extract is distilled to recover the solvent. The residue of the distillation forms a nitrogen-rich extract oil.

The nitrogen-lean raffinate which is substantially free of the extraction agent is passed to a distillation zone and heated sufficiently to vaporize a portion of the shale oil raffinate. The vaporized shale oil is condensed and forms a distillate having a further reduced nitrogen content. The nitrogen content of the distillate is sufficiently low that it may undergo further processing by a conventional crude petroleum refining process without further nitrogen reduction. The distillate may be contacted with an extraction agent, preferably a solid absorbant, for removing arsenic-containing compounds.

The unvaporized portion of the shale oil raffinate forms a bottoms which has an increased nitrogen content. The bottoms is passed to a hydrotreating zone wherein it is mildly hydrotreated to reduce the nitrogen level. The hydrotreated bottoms can be combined with the distillate.

The nitrogen-rich extract oil produced by the extraction can be combined with the bottoms prior to hydrotreating. The combination is then hydrotreated to maximize oil recovery.

The nitrogen-lean raffinate may be treated to recover any extraction agent that is present in the raffinate. When an organic acid solvent is used as the extraction agent, a small amount of the extraction agent generally dissolves into the shale oil and remains in the raffinate after it is separated from the extract. Such an organic acid solvent can be recovered by distilling the raffinate. The solvent is recovered as distillate and can be recycled.

Alternately, the nitrogen-rich extract oil can be processed to generate hydrogen gas for supplying at least a portion of the hydrogen required to hydrotreat the distillation bottoms. Nitrogen-rich extract oil is first treated to break the hydrocarbon compounds present in the extract oil into smaller compounds, a portion of which forms gaseous light hydrocarbons. Preferred methods include conventional coking and dealkylation processes. The gaseous light hydrocarbons are then mixed with steam at a high temperature and over a suitable catalyst to form hydrogen gas in a steam-reforming process. The hydrogen gas thus produced can be passed to the hydrotreating zone to supply at least a portion of the requirements for hydrotreating the distillation bottoms.

BRIEF DESCRIPTION OF THE DRAWINGS

These and other features and advantages of the present invention will be better understood by reference to the following detailed description when considered in conjunction with the accompanying drawing which is a flow diagram of a preferred embodiment of the invention.

DETAILED DESCRIPTION

In accordance with the present invention, crude or processed shale oil is upgraded by first introducing the shale oil to an extraction zone wherein nitrogen-containing compounds are chemically extracted by an extraction agent. The chemical extraction yields a high nitrogen extract and a low nitrogen raffinate. The low nitrogen raffinate is passed to a distillation zone wherein the shale oil raffinate is heated sufficiently to form a distillate having a further reduced nitrogen content. The distillate is capable of undergoing conventional crude petroleum refining without the need for any additional nitrogen removal processing steps. The distillation also produces a bottoms comprising hydrocarbon compounds having boiling points higher than the temperature of the distillation and having an increased nitrogen content. The bottoms is mildly hydrotreated to reduce its nitrogen content sufficiently to be passed to conventional crude petroleum refining.

As used herein, the term "crude shale oil" refers to the liquid product that is recovered from retorting of oil shale. The term encompasses liquid products formed during surface retorting processes or in situ oil shale retorting processes, which products have not undergone any further processes other than water removal or emulsion breaking. The term "processed shale oil" is used herein to indicate a crude shale oil which has undergone some processing, such as, for example, sulfur removal, fractionation, and the like.

It has been found that nitrogen-containing compounds are present in most crude or processed shale oils in a generally even distribution according to their boiling points. In other words, if such a shale oil were distilled into a select number of generally equal distillate fractions, the nitrogen content of each fraction would be roughly about the same.

It has also been found that in such a chemical extraction process, lighter nitrogen-containing compounds, having lower boiling points, are selectively extracted to a greater extent than heavier nitrogen-containing compounds having higher boiling points. Nitrogen-containing compounds remaining in the shale oil raffinate are, therefore, predominantly heavier nitrogen-containing compounds having higher boiling points and the extract tends to comprise a disproportionately high concentration of lighter, low boiling point nitrogen-containing compounds.

Nitrogen-containing compounds are removed from shale oil in the process by first introducing crude or processed shale oil as a continuous stream or in separate portions to an extraction zone containing an extraction agent capable of selectively extracting nitrogen-containing compounds from shale oil. The extraction agent is preferably a substantially immiscible aqueous acid solvent containing an organic acid having a high selectivity for extracting and retaining nitrogen-containing compounds.

As used herein, "substantially immiscible" solvent refers to solvents that are totally immiscible in shale oil and, additionally, to solvents that are partially miscible in shale oil in an amount less than about 5% by weight of the shale oil.

It is presently preferred than an aqueous acid solvent comprising an organic acid be used as the extraction agent because solvents comprising inorganic acids or salts have a greater tendency to form emulsions with shale oil than organic acids and therefore require longer separation times. The presently preferred organic acids are acetic acid and formic acid.

The amount of water mixed with the organic acid in the aqueous solvent is in the range of from about 0.5% to about 50% and preferably from about 10% to about 30%, depending on the acid selected. The amount of water is sufficient to make the acid substantially immiscible with shale oil. The amount of water is chosen to achieve the desired selectivity toward extraction and retention of nitrogen-containing compounds in the shale oil. A small amount of water, i.e., a high concentration of the organic acid, results in a high capacity for extracting the retaining nitrogen-containing compounds, but also results in a loss of selectivity towards extracting nitrogen-containing compounds and, therefore, increases the extraction of desirable non-nitrogen-containing compounds. A large amount of water, i.e., a low organic acid concentration, results in high selectivity for extracting only nitrogen-containing compounds, but also results in a loss of solubility of the nitrogen-containing compounds in the solvent, leading to an insufficient reduction of the nitrogen content of the shale oil.

The concentration of the organic acid in the aqueous solvent is preferably maintained at a level that maximizes the amount of nitrogen-containing compounds that can be extracted without extracting a significant amount of non-nitrogen-containing compounds. As used herein, "a significant amount of non-nitrogen-containing compounds" constitutes less than 10 percent of the non-nitrogen-containing compounds present in the shale oil. This has the effect of maximizing oil recovery.

Extractions using solvents comprising formic or acetic acid can generally reduce the nitrogen content by about 60% to about 70% without significantly reducing the oil recovery, i.e., extracting a less than 10 percent of the non-nitrogen-containing compounds.

The volume ratio of aqueous solvent to shale oil that is required for extracting nitrogen-containing compounds from the shale oil depends upon the nitrogen content in the shale oil and the solubility of such nitrogen-containing compounds in the solvent. The ratio of solvent to shale oil can be from about 5 parts solvent for each part shale oil to about 1 part solvent per 10 parts shale oil. The preferred solvent-shale oil ratio maximizes nitrogen removal without significant loss of non-nitrogen-containing compounds.

The extraction can be conducted at ambient temperature. However, it is preferred that an elevated temperature in the range of about 60° to about 80° C. be used. Elevated temperatures significantly reduce the viscosity of shale oils. Less viscous shale oils generally require less contact time between the shale oil and solvent for nitrogen-containing compounds to contact and be extracted by the solvent less viscous shale oils generally require less settling time than more viscous shale oils. While requiring energy to heat the shale oilsolvent mixture and while increasing the vapor pressure of the acid solvent, a reduction in the viscosity of the shale oil due to an elevated temperature can be advantageous. The maximum temperature of the extraction mixture is that temperature which causes an undesirable loss of solvent due to an increase in the vapor pressure of the solvent. The maximum temperature, therefore, cannot exceed the boiling point of the solvent.

In a preferred embodiment of the invention, as shown in the drawing, the aqueous solvent is introduced by line 9 to a mixer settler 10 which forms an extraction zone. Crude or processed shale oil is introduced to the mixer settler 10 by a line 11. The shale oil and the aqueous solvent are mixed by a mixer 12 to achieve equilibrium rapidly. Average residence time in the mixing stage is from about 2 to about 3 minutes. Following mixing, about 15 to 60 minutes is generally required for settling of the lower solvent phase 14 from the upper shale oil phase 13. The upper shale oil phase 13 is then separated from the immiscible aqueous solvent phase 14 by conventional liquid-liquid separation techniques, e.g., decanting the upper phase or withdrawing the lower phase.

Successive extractions may be used to further reduce the nitrogen content of the shale oil. The conditions for each extraction are adjusted to minimize the loss of non-nitrogen-containing compounds and therefore maximize oil recovery.

Alternatively, nitrogen-containing compounds can be removed in a continuous extraction process. In such a process, a stream of shale oil is introduced to an extraction zone comprising a conventional countercurrent contactor. Typically, the extraction zone contains a downwardly-flowing acid solvent stream and an upwardly-flowing shale oil stream. As the shale oil moves upward, contact is made with the solvent stream and nitrogen-containing compounds are removed. Shale oil raffinate having a reduced nitrogen content is recovered at the top of the extraction zone and aqueous solvent extract containing nitrogen-containing compounds is recovered at the bottom of the extraction zone.

The products of the nitrogen extraction comprise a shale oil raffinate having a reduced nitrogen content and a high nitrogen extract.

The high nitrogen extract from the extraction zone contains nitrogen-containing compounds and solvent. The solvent is recovered by passing the high nitrogen extract to a first solvent recovery zone 16 by a line 17. The solvent is vaporized and recovered as distillate 18 in a condensation zone 19, with nitrogen-containing and other extracted shale oil compounds remaining as the residue or bottoms 20 of the distillation. The bottoms 20 forms a high-nitrogen extract oil. The solvent that is recovered is concentrated and recycled by line 21 to the extraction zone for use in a subsequent extraction to reduce the nitrogen content of additional shale oil.

Other methods for recovering the solvent may be used. For example, some of the nitrogen-containing compounds that are basic can be precipitated from the solvent by adding a stronger base. Alternatively, the nitrogen-containing compounds can be extracted from the solvent in another extraction process.

The high-nitrogen-containing extract oil recovered from the aqueous solvent can be treated to reduce its nitrogen content. Alternatively, it can be used as a feedstock for hydrogen gas generation. Or, because of its high nitrogen content, the high-nitrogen extract oil can be used in the production of nitrogen compounds and various chemical intermediates containing nitrogen. The residue can also be used as an asphalt, which provides good adhesive properties because of its nitrogen content and ability to crosslink through nitrogen.

The nitrogen-lean shale oil raffinate is passed from the mixer settler 10 by line 26 to a second solvent recovery zone 27 wherein the shale oil is heated sufficiently to vaporize at least a portion of the solvent present in the shale oil raffinate. The solvent is condensed in a condensation zone 28 and forms a distillate 29. The recovered solvent is concentrated and recycled by line 30 to the extraction zone.

The shale oil raffinate having a reduced solvent content is passed by line 31 to a distillation zone 32 wherein the shale oil is heated sufficiently to vaporize a portion of the shale oil. The vaporized portion contains lighter shale oil compounds which have lower boiling points than the non-vaporized portion. The vaporized portion is condensed in a condensation zone 33 and forms a distillate 34. Because the nitrogen-containing compounds in the shale oil raffinate are predominately heavier compounds, having higher boiling points, few nitrogen-containing compounds are vaporized and condensed in the distillate.

Heavier nitrogen-containing compounds in the raffinate, including heavier non-nitrogen-containing hydrocarbon compounds, generally require a higher distillation temperature to be vaporized than the lighter shale oil compounds. At the preferred distillation temperatures, these compounds, which do not vaporize, form a residue or bottoms 35, i.e., an undistilled portion, which has an increased nitrogen concentration.

The distillate 34 produced by the shale oil distillation has a nitrogen content sufficiently low to enable it to be passed to conventional crude petroleum refining without the need for additional nitrogen removing processing steps. Specifically, this fraction does not require hydrotreating to further reduce the nitrogen content prior to conventional crude petroleum refining.

The nitrogen content of crude petroleum is typically less than about 3,000 ppm, and in most cases less than about 2,000 ppm. This amount of nitrogen does not deleteriously effect the hydrogenation, reforming, hydrocracking and catlytic cracking reactions of conventional crude petroleum refining.

The temperature of the distillation is therefore adjusted to produce a distillate 34 which contains less than about 3,000 ppm of elemental nitrogen and preferably less than about 2,000 ppm nitrogen. The temperature of the distillation is preferably maintained at the highest temperature that generates such a distillate and is dependent on the nitrogen content of the raffinate introduced into the distillation zone and on the relative proportions of lighter and heavier non-nitrogen-containing nitrogen-containing hydrocarbons remaining in the raffinate after the extraction the temperature selected, therefore, produces the maximum amount of distillate having such a nitrogen content, i.e., generates the maximum yield.

It is presently preferred that the distillation operation comprise an atmospheric distillation as this is believed to be the most economical method. However, vacuum distillation, vacuum flashing, atmospheric flashing processes and the like are also applicable to this process.

The distillation can be carried out to yield a select number of separate distillate fractions. In such a process, a first fraction contains lighter hydrocarbons which have lower boiling points than hydrocarbons condensed in a second fraction which, in turn, contains hydrocarbons having lower boiling points than the next fraction. The last fraction that is collected contains hydrocarbons having the highest boiling points of the fractions collected and also has the highest nitrogen content.

The temperature of such a fractional distillation process is controlled so that the nitrogen content of the last fraction is no more than the desired limit, i.e., about 3,000 ppm, and preferably about 2,000 ppm. All fractions thus have a nitrogen content below the desired limit. The amount of shale oil components collected in each fraction depend on the number of fractions collected, the relative proportions of high and low boiling point nitrogen-containing and non-nitrogen-containing shale oil compounds in the raffinate and the total nitrogen content of the shale oil raffinate introduced into the distillation zone.

The advantage of generating a select number of distillate fractions is that each fraction generally comprises hydrocarbon compounds within different molecular weight ranges. Because of the reduced nitrogen content, these fractions can be readily blended with similar fractions obtained from the fractionation of crude petroleum in conventional refining processes of the crude petroleum.

In addition, by collecting the distillate in consecutive fractions, the second solvent recovery zone can be eliminated. The solvent that is present in the raffinate following the extraction can be recovered as the first collected fraction substantially free of shale oil compounds and recycled to the extraction zone.

The nitrogen-lean distillate produced by either a simple or fractional distillation may be contacted with an arsenic extraction agent, preferably a solid absorbent, capable of extracting arsenic-containing compounds from the shale oil for a period sufficient to extract substantially all of the arsenic-containing compounds. The arsenic content can also be reduced by a mild hydrotreatment. However, removal by an extraction agent is preferred as this reduces the overall hydrogen gas consumption of the process. Examples of such extraction agents for arsenic-containing compounds are disclosed in U.S. Pat. Nos. 2,778,779 to Donaldson, 3,542,669 to DeFeo and 4,046,674 to Young, all of which are incorporated herein by this reference.

The bottoms 35, i.e., the shale oil fraction not vaporized, of the distillation operation, although having a lower nitrogen content than the original shale oil feed to the extraction zone, comprises a nitrogen content too high to be passed directly to conventional crude petroleum refining.

The bottom 35 is therefore introduced by line 36 to a guard bed 37 in which arsenic-containing compounds are removed and then by line 38 to a hydrotreating zone 39 in which the nitrogen-rich shale oil undergoes a mild hydrotreatment to reduce the nitrogen content.

The guard bed 37 prevents fouling of the hydrogenation catalyst in the hydrotreating zone by arsenic-containing compounds present in shale oil by removing those compounds before the shale oil is introduced to the hydrotreating zone. In the guard bed 37, hydrogen gas and shale oil are mixed and passed over a catalyst bed at an appropriate temperature and pressure. Arsenic-containing compounds are removed from the shale oil by deposition on the catalyst. The catalysts that are used in such a guard bed are inexpensive and commercially available and are generally discarded after use.

Nitrogen-containing compounds tend to be more difficult to remove from shale oil than arsenic-containing compounds. The conditions maintained in the guard bed, including temperature, pressure and the partial pressure of hydrogen gas, are generally insufficient to remove nitrogen-containing compounds from the bottoms. To remove the nitrogen-containing compounds, the arsenic-depleted shale oil bottoms is passed to a hydrotreating zone.

In the hydrotreating zone 39, the shale oil bottoms is mixed with hydrogen gas at an elevated temperature and pressure and passed over a hydrogenation catalyst.

The temperature, pressure, and flow that are required depend on the nitrogen content of the shale oil bottoms but are typically in the ranges 800 to 1500 psig., 0.5 to 1.0 LHSV, and 650° to 700° F. Applicable catalysts include nickel-molybdenum catalysts. Under such conditions, nitrogen-containing compounds react to form gaseous ammonia which is then separated from the shale oil. In addition, sulfur-containing compounds present in the shale oil react to form hydrogen sulfide gas which is likewise removed, thereby reducing the sulfur content of the shale oil.

Conditions in the hydrotreating zone are maintained at levels in which sufficient nitrogen-containing compounds in the shale oil are converted to ammonia to reduce the nitrogen content of the shale oil to no more than about 3,000 ppm and preferably to no more than about 2,000 ppm. The shale oil is then separated from the gas phase. Shale oil thus hydrotreated is in condition to undergo further processing by a conventional crude petroleum refining process and can be combined with the distillate portion of the shale oil raffinate.

After separation from the solvent, the nitrogen-rich oil of the extract is generally discarded. However, it may be combined with the bottoms from the distillation zone, if desired. The combination would be passed through the guard bed wherein arsenic-containing compounds are removed and then through the hydrotreating zone wherein nitrogen-containing compounds are removed as previously described. Hydrotreating the combined extract oil and distillation bottoms would bottoms increase oil recovery but would requires more severe hydrotreating conditions and therefore cause a higher hydrogen gas consumption.

Rather than discarding the high-nitrogen extract oil recovered from the solvent extraction, or combining it with the raffinate distillation bottoms, the high-nitrogen extract oil is preferably processed to generate a gas stream of light hydrocarbon compounds, i.e., hydrocarbon compounds having from one to four carbon atoms. The gas stream containing light hydrocarbons is then used to generate hydrogen gas which can be used in the hydrotreatment of the bottoms of the raffinate distillation.

It has been found that the basic nitrogen-containing compounds which predominate the high-nitrogen extract oil are predominantly composed of a homologous series of aromatic nitrogen compounds starting with substituted pyridines that include quinolines, benzoquinolines and the like. These basic nitrogen compounds are highly substituted with alkyl groups. In the particularly preferred embodiment, these alkyl groups are cleaved from the aromatic ring structure and form gaseous light hydrocarbons.

A preferred method for producing such gaseous light hydrocarbons from the nitrogen-rich extract oil is a conventional coking process. In such a process, the nitrogen-rich extract oil is heated generally to from about 900° to about 1000° F. at a select pressure, generally from about 30–60 psi, to cleave or crack the hydrocarbon compounds, resulting in the formation of smaller compounds. Typically cleavage will occur where an alkyl group is attached to an aromatic group. The cracked lighter hydrocarbons form a gaseous product which is collected. Heavier cleaved alkyl groups form a liquid which can be separated and added to the low-nitrogen distillate. A solid coke is also formed which can be used in a variety of applicatons, such as in the manufacture of anodes and graphite and a source for carbides.

Another preferred method for generating gaseous light hydrocarbons is a dealkylation process. In such a process which may be catalytic or non-catalytic, the nitrogen-rich extract oil is contacted with hydrogen and steam at a temperature and pressure sufficient to dealkylate the aromatic compounds. In a non-catalytic dealkylation process, the reaction temperature is generally from about 1100° F. to about 1500° F. and the pressure range from about 300 psi to about 1000 psi. Residence time can be as low as a few seconds. When a catalyst, such as metallic chromium, platinum, rhodium or cobalt on an alumina or zeolite substrate, is used, reaction temperatures and pressures may be lower, typically requiring a temperature of from about 900° F. to about 1300° F. and a pressure of from about 150 psi to about 600 psi.

At least a portion of the alkyl substituents are cleaved and form a gaseous product of light hydrocarbons. The dealkylated aromatic structures produced by such a process are pure nitrogen-containing aromatic compounds which may be used as a chemical feed stock.

The gaseous light hydrocarbon product is utilized for generating hydrogen gas by a steam reforming process. In an exemplary steam reforming process, the gaseous product containing light hydrocarbons is reacted with steam at elevated pressure and temperature, typically about 1500° F. and 250 psi, in the presence of a nickel catalyst to form a mixture of carbon monoxide and hydrogen. The reaction products are cooled and then mixed with additional steam at about 660° F. and the same pressure over a metallic iron catalyst wherein carbon monoxide and water react to form carbon dioxide and additional hydrogen.

The hydrogen gas is then treated to remove carbon dioxide by a conventional method, such as a method described in *Report 32A of the Stanford Research Institute* by George E. Haddleland which was issued in December of 1973. For example, the gaseous product of the steam reformation process could be contacted with potassium carbonate and water at about 225° F. and 260 psi. In such a process, one mole each of potassium carbonate and water react with one mole of carbon dioxide to form two moles of potassium bicarbonate. The separated hydrogen gas can be passed to the hydrotreating zone to supply at least a portion of the hydrogen gas required to hydrotreat the bottoms of the raffinate distillation.

This invention is applicable to shale oil upgrading process comprising an initial hydrotreatment to remove or reduce the concentration of sulfur, arsenic and iron from a shale oil feed. In such a process, crude shale oil is hydrotreated under mild conditions, i.e., low temperature and pressures. Very little nitrogen is removed in such an initial hydrotreatment.

The product of the initial hydrotreatment is then introduced into an extraction zone as described above wherein a portion of the nitrogen-containing compounds are removed. The nitrogen-lean raffinate of the extraction zone is then introduced to a distillation zone and the raffinate is distilled sufficiently to produce a low nitrogen distillate and a high nitrogen bottoms. The bottoms of the distillation is then mildly hydrotreated to lower the nitrogen content. The low nitrogen distillate produced by the distillation and the hydrotreated bottoms are suitable for refining by conventional crude petroleum refining processes.

The preceding description has been presented with reference to the presently preferred embodiments of the invention shown in the accompanying drawing. Workers skilled in the art and technology to which this invention pertains will appreciate that alterations and changes in the described process can be practiced without meaningfully departing from the principles, spirit and scope of this invention. Accordingly, the foregoing description should not be read as pertaining only to the precise procedures described, but rather should be read consistent with and as support for the following claims which are to have their fullest fair scope.

What is claimed is:

1. A process for reducing the nitrogen content of shale oil containing nitrogen-containing compounds comprising:

extracting a portion of the nitrogen-containing compounds from shale oil by contacting the shale oil with an extraction agent capable of selectively extracting nitrogen-containing compounds from shale oil to form a nitrogen-lean shale oil;

vaporizing a portion of the nitrogen-lean shale oil; and condensing the vaporized shale oil to form a shale oil condensate having a further reduced nitrogen content.

2. A process as claimed in claim 1 wherein the extraction agent comprises an aqueous solvent comprising at least one organic acid, said aqueous solvent being immiscible with the shale oil.

3. A process as claimed in claim 1 wherein the shale oil condensate has a nitrogen content of about 3000 ppm.

4. A process as claimed in claim 1 further comprising hydrotreating the unvaporized portion of the nitrogen-lean shale oil to remove nitrogen-containing compounds.

5. A process for reducing the nitrogen content of shale oil feed containing lighter and heavier compounds comprising:

selectively removing lighter compounds containing nitrogen from a shale oil feed to form a nitrogen-depleted raffinate;

heating the raffinate sufficiently to vaporize at least a portion of the remaining lighter compounds; and condensing the vaporized lighter compounds to form at least one shale oil distillate fraction having a further reduced nitrogen content.

6. A process as claimed in claim 5 wherein the lighter compounds containing nitrogen are removed by contacting the shale oil feed with an extraction agent capable of selectively extracting lighter nitrogen-containing compounds from shale oil.

7. A process as claimed in claim 6 wherein the extraction agent extracts less than about 10% of the non-nitrogen-containing compounds presesnt in the shale oil.

8. A process as claimed in claim 5 wherein the nitrogen content of the condensed shale oil distillate fraction is no more than about 3,000 ppm.

9. A process as claimed in claim 5 wherein the nitrogen content of the condensed shale oil distillate fraction is no more than about 2,000 ppm.

10. A process for reducing the nitrogen content of shale oil comprising:

contacting shale oil with an extraction agent capable of selectively extracting nitrogen-containing compounds from shale oil for a time sufficient to form a nitrogen-lean raffinate and a nitrogen-rich extract;

separating the nitrogen-lean raffinate from the nitrogen-rich extract; and distilling the nitrogen-lean raffinate to form a distillate having a further reduced nitrogen content which is collected in at least one fraction and a residue having an increased nitrogen content.

11. A process as claimed in claim 10 wherein the extraction agent comprises an aqueous acid solvent.

12. A process as claimed in claim 11 wherein the aqueous acid solvent comprises an organic acid component selected from the group consisting of formic acid, acetic acid and mixtures thereof.

13. A process as claimed in claim 10 further comprising hydrotreating the residue sufficiently to reduce the nitrogen content of the residue to at least about the nitrogen concentration of the distillate.

14. A process for reducing the nitrogen content of shale oil comprising:

contacting in an extraction zone, shale oil with an extraction agent capable of selectively extracting nitrogen-containing compounds from shale oil for a time sufficient to form nitrogen-lean shale oil and nitrogen-rich extract;

separating the nitrogen-lean shale oil from the nitrogen-rich extract;

passing the nitrogen-lean shale oil to a distillation zone wherein the nitrogen-lean shale oil is distilled to form a distillate having no more than about 3,000 ppm nitrogen and a bottoms having an increased nitrogen content; and hydrotreating the bottoms to reduce the nitrogen content of the bottoms.

15. A process as claimed in claim 14 wherein the bottoms has a nitrogen content of no more than about 3,000 ppm after hydrotreating.

16. A process as claimed in claim 14 wherein the extraction agent comprises an solvent containing an organic acid, said solvent being immiscible with the shale oil.

17. A process as claimed in claim 16 wherein the organic acid is selected from the group consisting of formic acid, acetic acid and mixtures thereof.

18. A process as claimed in claim 14 further comprising separating the extraction agent from shale oil compounds present in the extract.

19. A process as claimed in claim 18 wherein the extraction agent comprises an organic acid solvent and at least a portion of the organic acid solvent is separated from the shale oil compounds in the extract by distillation.

20. A process as claimed in claim 14 wherein the temperature of the distillation zone is adjusted to maximize the quantity of distillate formed.

21. A process as claimed in claim 14 wherein the distillate is collected in a number of fractions, each fraction having a nitrogen content not exceeding about 3,000 ppm.

22. A process as claimed in claim 14 wherein the nitrogen content of the distillate is no more than about 2,000 ppm.

23. A process as claimed in claim 14 wherein the nitrogen content of the bottoms is no more than about 2,000 ppm after hydrotreating.

24. A process for upgrading shale oil comprising:

contacting a shale oil feed with an extraction agent capable of selectively extracting nitrogen-containing compounds from shale oil for a time sufficient to form a nitrogen-rich extract comprising the extraction agent and nitrogen-containing compounds and a nitrogen-lean raffinate;

separating the nitrogen-rich extract from the nitrogen-lean raffinate;

removing at least a portion of the extraction agent from the extract to thereby form a high-nitrogen extract oil;

distilling the nitrogen-lean raffinate to form a distillate having a nitrogen content of no more than about 3,000 ppm and a bottoms having an increased nitrogen content; and hydrotreating the bottom sufficiently to reduce the nitrogen content of the bottoms to no more than about 3,000 ppm.

25. A process as claimed in claim 24 further comprising combining the high-nitrogen extract oil with the bottoms, and hydrotreating the combination to reduce the nitrogen content of the combination to no more than about 3,000 ppm.

26. A process as claimed in claim 24 wherein the distillate is collected in a number of fractions, each fraction having a nitrogen content not exceeding about 3,000 ppm.

27. A process as claimed in claim 24 wherein the high-nitrogen extract oil comprises at least about 50 percent of the nitrogen containing compounds present in the shale oil feed and less than about 10 percent of the non-nitrogen-containing compounds present in the shale oil feed.

28. A process as claimed in claim 24 further comprising removing at least a portion of arsenic-containing compounds present in the bottoms prior to hydrotreating the bottoms.

29. A process for reducing the nitrogen content of shale oil comprising:

introducing shale oil feed to an extraction zone containing a solvent which is substantially immiscible with said shale oil, said solvent comprising an organic acid component selected from the group consisting of acetic acid, formic acid and mixtures thereof, and contacting said solvent for a time sufficient to form a nitrogen-lean raffinate and a nitrogen-rich extract comprising solvent and nitrogen-containing compounds;

separating the nitrogen-lean raffinate from the nitrogen-rich extract;

distilling the nitrogen-rich extact to form a first solvent distillate comprising at least a portion of the organic acid component substantially free of nitrogen-containing compounds and a residue comprising a high-nitrogen extract oil;

distilling the nitrogen-lean raffinate sufficiently to form a second solvent distillate comprising organic acid component that has dissolved in the raffinate and a shale oil distillate which is collected in a number of fractions wherein each fraction has a nitrogen content of no more than about 3,000 ppm, and a bottoms having a nitrogen content greater than that of the shale oil distillate; and hydrotreating the bottoms sufficiently to reduce the nitrogen content of the bottoms to no more than about 3,000 ppm.

30. A process as claimed in claim 29 further comprising contacting the shale oil distillate with an extraction agent capable of selectively extracting arsenic-containing compounds from shale oil for a time sufficient to remove at least a portion of the arsenic-containing compounds present in the distillate.

31. A process as claimed in claim 29 further comprising passing the bottoms through a guard bed to remove substantially all aresenic-containing compounds before hydrotreating the bottoms.

32. A process for upgrading a shale oil feed containing lighter and heavier shale oil compounds containing nitrogen, the process comprising the steps of:

mixing the shale oil feed with an extraction agent capable of selectively extracting lighter shale oil compounds containing nitrogen from the shale oil feed for a time sufficient to form a nitrogen-rich extract comprising the extraction agent and extracted lighter shale oil compounds containing nitrogen and a nitrogen-lean raffinate comprising non-extracted shale oil compounds and dissolved extraction agent;

separating the nitrogen-lean raffinate from the nitrogen-rich extract;

removing at least a portion of the extraction agent from the extract to form a high-nitrogen extract oil comprising extracted lighter shale oil compounds containing nitrogen;

removing at least a portion of the dissolved extraction agent from the nitrogen-lean raffinate to form a treated raffinate;

heating the treated raffinate sufficiently to vaporize lighter shale oil compounds;

condensing the vaporized lighter shale oil compounds in a number of fractions, each fraction having a nitrogen content of no more than about 3,000 ppm; and hydrotreating the remaining unvaporized heavier shale oil compounds to reduce the nitrogen content of the unvaporized heavier shale oil compounds to no more than about 3,000 ppm.

33. A process as claimed in claim 32 wherein less than 10% of the non-nitrogen-containing compounds of the shale oil feed are extracted by the extraction agent.

34. A process as claimed in claim 33 further comprising:

dealkylating at least a portion of the hydrocarbon compounds in the high-nitrogen extract oil to form gaseous light hydrocarbons;

forming hydrogen and carbon dioxide from the gaseous lighter hydrocarbons by a steam reforming process; and separating the formed hydrogen from the carbon dioxide.

35. A process as claimed in claim 34 wherein the hydrocarbon compounds in the high-nitrogen extract oil are dealkylated by a coking process wherein the high-nitrogen extract oil is heated to a temperature and at a pressure sufficient to dealkylate at least a portion of the hydrocarbon compounds.

36. A process as claimed in claim 34 wherein the hydrocarbon compounds in the high-nitrogen extract oil are dealkylated by a steam dealkylation process wherein the high-nitrogen extract oil is mixed with hydrogen and steam at a temperature and pressure sufficient to dealkylate at least a portion of the hydrocarbon compounds.

37. A process as claimed in claim 33 further comprising passing at least a portion of the separated hydrogen to the hydrotreating zone to supply at least a portion of the hydrogen requirements for hydrotreating the bottoms.

38. A process for upgrading shale oil comprising:

contacting a shale oil feed with an extraction agent capable of selectively extracting nitrogen-containing compounds from shale oil for a time sufficient for the extraction agent to extract a portion of the nitrogen-containing compounds present in the shale oil feed to form a nitrogen-rich extract comprising the extraction agent and nitrogen-containing compounds and a nitrogen-lean raffinate;

separating the nitrogen-rich extract from the nitrogen-lean raffinate;

removing at least a portion of the extraction agent from the nitrogen-rich extract to thereby form a high-nitrogen extract oil;

dealkylating at least a portion of the hydrocarbon compounds in the high-nitrogen extract oil to form gaseous light hydrocarbons;

converting at least a portion of the gaseous lighter hydrocarbons to hydrogen and carbon dioxide by a steam reforming process; and separating the formed hydrogen from the carbon dioxide.

39. A process as claimed in claim 38 wherein the extraction agent comprises an aqueous acid solvent.

40. A process as claimed in claim 39 wherein the aqueous acid solvent comprises an organic acid component selected from the group consisting of formic acid, acetic acid and mixtures thereof.

41. A process as claimed in claim 38 wherein hydrocarbon compounds in the high-nitrogen extract oil are dealkylated by a coking process wherein the high-nitrogen extract oil is heated to a temperature and a pressure sufficient to dealkylate at least a portion of the hydrocarbon compounds for a time sufficient to form gaseous lighter hydrocarbons.

42. A process as claimed in claim 41 wherein the high-nitrogen extract oil is heated from about 900° to about 1000° F. at a pressure from about 30 to about 60 psi.

43. A process as claimed in claim 38 wherein hydrocarbon compounds in the high-nitrogen extract oil are dealkylated by a steam dealkylation process wherein the high-nitrogen extract oil is mixed with hydrogen and steam at a temperature and pressure sufficient to dealkylate at least a portion of the hydrocarbon compounds for a time sufficient to form gaseous lighter hydrocarbons.

44. A process as claimed in claim 43 wherein the high-nitrogen extract oil is mixed with hydrogen and steam at a temperature of from about 1100° to about 1500° F. and at a pressure of from about 300 to about 1,000 psi.

45. A process as claimed in claim 43 wherein the high-nitrogen extract oil is mixed with hydrogen and steam at a temperature of from about 900° to about 1300° F., at a pressure of from about 150 to about 600 psi and in the presence of a catalyst selected from the group consisting of chromium, platinum, rhodium, cobalt and combinations thereof supported on a substrate selected from alumina and zeolite.

46. A process as claimed in claim 38 wherein at least a portion of the gaseous lighter hydrocarbons are converted to hydrogen and carbon dioxide by a process comprising the steps of:

mixing the gaseous lighter hydrocarbons with steam in the presence of a nickel catalyst at a first temperature and first pressure and for a time sufficient to form a product gas comprising carbon monoxide and hydrogen;

contacting the product gas with steam in the presence of an iron catalyst at a second temperature and second pressure sufficient to form additional hydrogen by reaction of carbon monoxide and water.

47. A process as claimed in claim 46 wherein the first temperature is about 1500° F. and the first pressure is about 250 psi.

48. A process as claimed in claim 46 wherein the second temperature is about 660° F. and the second pressure is about 250 psi.

49. A process as claimed in claim 38 further comprising passing at least a portion of the separated hydrogen to a hydrotreating zone to supply at least a portion of the hydrogen requirement of the hydrotreating zone.

* * * * *